US007104626B2

(12) United States Patent
Oyen

(10) Patent No.: US 7,104,626 B2
(45) Date of Patent: Sep. 12, 2006

(54) PRINTING METHOD AND PRINTER WITH FAILURE COMPENSATION

(75) Inventor: Johannes P. H. Oyen, Roermond (NL)

(73) Assignee: Oce-Technologies B.V., Ma Venlo (NL)

( * ) Notice: Subject to any disclaimer, the term of this patent is extended or adjusted under 35 U.S.C. 154(b) by 248 days.

(21) Appl. No.: 10/785,223

(22) Filed: Feb. 25, 2004

(65) Prior Publication Data

US 2004/0165016 A1 Aug. 26, 2004

(30) Foreign Application Priority Data

Feb. 26, 2003 (EP) ..... 03075838

(51) Int. Cl.
*B41J 29/393* (2006.01)
*B41J 29/38* (2006.01)

(52) U.S. Cl. ..... 347/19; 347/9; 347/14

(58) Field of Classification Search ..... 347/19, 347/9, 14

See application file for complete search history.

(56) References Cited

U.S. PATENT DOCUMENTS 6,149,264 A 11/2000 Hirabayashi et al.
6,354,689 B1 * 3/2002 Couwenhoven et al. ..... 347/19
6,908,176 B1 * 6/2005 Koitabashi et al. ..... 347/43

FOREIGN PATENT DOCUMENTS

| | | | |
|---|---|---|---|
| EP | 0 981 105 | A | 2/2000 |
| EP | 0 983 855 | A | 3/2000 |
| EP | 1 060 896 | A1 | 12/2000 |
| EP | 1 080 899 | A | 3/2001 |
| EP | 1 151 867 | A | 11/2001 |

* cited by examiner

*Primary Examiner*—Lamson Nguyen
*Assistant Examiner*—Jannelle M. Lebron
(74) *Attorney, Agent, or Firm*—Birch, Stewart, Kolasch & Birch, LLP

(57) ABSTRACT

A printer including a transport system for a recording medium, a printhead containing a plurality of print units each of which being capable of printing a pixel line when the printhead is scanned over the recording medium, and a failure compensation unit for controlling the print operation such that a failure of a print unit is compensated, wherein a segmentation unit is provided for dividing an image to be printed into segments containing different types of image information, and wherein the failure compensation unit includes a memory for storing a plurality of compensation strategies and a controller for selecting one of said compensation strategies in accordance with the segment to be printed.

14 Claims, 7 Drawing Sheets

PRINTING METHOD AND PRINTER WITH FAILURE COMPENSATION

This non-provisional application claims priority under 35 U.S.C. § 119(a) on Patent Application No. 03075838.7, filed in Europe on Feb. 26, 2003, which is herein incorporated by reference.

BACKGROUND OF THE INVENTION

The present invention relates to a printing method for a printer containing a transport system for a recording medium, and a printhead with a plurality of print units, each of which is capable of printing a pixel line when the printhead is scanned over the recording medium, wherein a failure compensation unit controls the print operation and compensates for a failure of a print unit.

An example of a printer of this type is disclosed in EP-A-0 981 105, which relates to an ink jet printer. In the printhead of this printer, the print units are formed by ink jet nozzles which are arranged in a linear array extending in the direction in which the recording medium is transported. Thus, when the printhead is scanned over the recording medium, a swath of an image can be printed, and the number of pixel lines in the swath corresponds essentially to the number of nozzles present in the printhead.

Such a printer can generally operate in different print modes. In a single-pass mode, each nozzle of the printhead prints the complete image information of a pixel line during a stroke in which the printhead is moved over the paper. Then, the paper is transported over the width of the swath that has been printed, and the next swath is printed in a return stroke of the printhead. As an alternative, a two-pass mode may be applied, in which each nozzle prints only every second pixel of the corresponding line during the first stroke, and the missing pixels are inserted in the return stroke of the printhead. In this mode, the paper may be transported in steps which correspond to only half the length of the nozzle array. Then, one half of the nozzles will be used for printing every second pixel of a new swath, whereas the other half of the nozzles is used for inserting the missing pixels in the swath that had been printed in the previous stroke. As a result, two different nozzles will be involved in printing all the pixels of a given pixel line.

If a nozzle of the printhead becomes clogged or fails for any other reason, the pixels that would have been printed with the inoperative nozzle will be missing in the printed image, and the image quality will be impaired. A variety of failure compensation strategies are known for avoiding or mitigating this undesirable effect.

For example, the above-mentioned document proposes a compensation strategy which employs the two-pass mode. Here, the job of the inoperative nozzle is taken over by the nozzle which is normally utilized only for inserting the missing pixels. Of course, if the scanning speed of the printhead is not reduced, this requires that the nozzle that is used for failure compensation is capable of printing pixels with twice the normal frequency.

EP-A-1 060 896 discloses a failure compensation strategy which is also applicable in a single-pass mode. When, in the event of breakdown of a nozzle, a specific pixel should but cannot be printed with the inoperative nozzle, this pixel is transferred to an addressable position in the vicinity of the designated pixel position, so that it can be printed with another nozzle. This strategy helps to prevent loss of information but will not fully compensate the nozzle failure and is in many cases sufficient for suppressing the visual effect of the nozzle failure below acceptable limits.

Another known failure compensation strategy is particularly applicable to the case where a breakdown of a nozzle or, more generally, a print unit occurs near the end of the nozzle array. Then, an end section of the nozzle array, which section includes the inoperative nozzle, is cut-off, i.e. the nozzles of this section are disabled. As a result, the usable length of the nozzle array is somewhat reduced, and the swath of the image that is printed in a single stroke is reduced in width. By adapting the transport width of the recording medium to the reduced width of the swath, a defect-free image can be printed, although at the cost of productivity.

In general, unless redundant nozzles are present in the printhead, failure compensation involves a tradeoff between productivity and image quality.

SUMMARY OF THE INVENTION

An object of the present invention is to provide a printing method and a printer that are capable of optimizing the failure compensation strategy in terms of productivity and image quality for a large variety of images to be printed.

To this end, the printing method according to the present invention includes the steps of

- storing a plurality of failure compensation strategies,
- dividing an image to be printed into segments containing different types of image information, and
- selecting different ones of the stored compensation strategies for printing different segments of the image.

As is generally known in the art, a segmentation process may be employed for analyzing the contents of an image to be printed and for identifying different types of image information such as text, CAD graphics, photographs and the like. In this way, it is possible for example to identify those parts of a page to be printed which contain photographs for which a halftone processing of the print data is necessary, whereas other parts of the page, e.g., text, do not need halftone processing. A segmentation process may also be used for automatically adapting the operation mode of the printer to the type of image information to be printed, so that different segments of a page may respectively be printed with the most suitable operation mode of the printer. For example, U.S. Pat. No. 6,149,264 discloses a printer in which a page to be printed is segmented into text areas and graphic areas, and a single-pass mode is adapted for text, whereas graphic data are printed in a two-pass mode.

According to the present invention, segmentation is employed for automatically switching between different failure compensation strategies, so that each segment of the image will be printed with a failure compensation strategy that is most suitable for the type of image information contained in the respective segment.

For example, the shift-type failure compensation strategy disclosed in EP-A-1 060 896, in which the black pixels that cannot be printed are shifted to neighboring locations, will be most suitable for relatively bright image areas, i.e. image areas in which the density of black pixels is comparatively low, so that a sufficient number of white pixel locations is available to which the black pixels may be shifted. In contrast, in a relatively dark image area, e.g. a solid black area, this compensation strategy is likely to lead to a visible defect in the printed image. In order to achieve a high image quality in such dark image areas, it would therefore be preferable to adopt one of the other failure compensation strategies discussed above which are capable of fully compensating the defect but which will generally lead to certain losses in productivity. It is a main advantage of the present invention that, when a page to be printed contains both, dark and bright image areas, it is not necessary to use a relatively slow failure compensation strategy, which assures a good image quality in the dark areas, for the whole page, but it is possible to use this slower strategy only where it is actually needed, whereas other parts of the page, i.e. the bright image areas, can be printed with a more productive failure compensation strategy which nevertheless provides a sufficient image quality in these areas. As a result, it is possible to achieve a satisfactory image quality and nevertheless to increase the overall productivity of the print operation.

Although it would be feasible to change the failure compensation strategy even within a single stroke of the printhead, it will generally be more efficient to retain one and the same compensation strategy for a complete printhead stroke. Thus, the segments identified in the segmentation process will preferably consist of swaths or bands that extend over the whole width of the page and correspond to an integral number of strokes of the printhead. Then, the part of the segment that is most sensitive to failure of a print unit will determine the compensation strategy to be adopted.

In a preferred embodiment, the printer comprises a failure detection system which automatically detects failures of print units, so that appropriate failure compensation strategies may be activated automatically. Failure detection and compensation may even be performed "on the fly", i.e. while the printer is operating. Then, when a nozzle failure occurs at a time when the printer has printed a part of a page, the failure compensation unit will be activated immediately, so that the printer can continue with printing average number of black pixels contained in a given basic area. The minimum requirement for image quality and hence the failure compensation strategy to be applied may then be determined simply by setting threshold values to which the primary image classifiers are compared. In order to increase the sensitivity of the segmentation process, there may be provided a set of different primary image classifiers which differ from one another in the size of the basic area. Each classifier may then be compared to an associated threshold value, and the comparison results may be filtered with an appropriate filter in order to determine the ultimate compensation strategy.

It has been observed that a defect in the printed image, which defect may be the result of an incomplete failure compensation, is less perceptible to the human eye when there exists a high level of high-frequency contrast in the vicinity of the defect. In order to take advantage of this effect, it is preferable to employ a context filtering procedure in the segmentation process. The context filter may be applied to the primary classifiers or, alternatively, to the associated threshold values, e.g. by shifting the threshold values depending on the level of contrast in the basic area or the vicinity thereof.

The size of the segments determined in the segmentation process will naturally be adapted to the pattern of swaths printed by the printhead, i.e. the length of the nozzle array in the direction of paper transport. Since a frequent switching between different failure the rest of the page with failure compensation. Thus, visible defects in the printed image will only occur in the relatively short delay time between the detection of a nozzle failure and the time when the failure compensation unit becomes effective.

In some cases, however, even a short delay time between failure detection and failure compensation may lead to an unacceptable loss of image information. This is particularly the case when a thin horizontal line has to be printed, i.e. a line which extends in the scanning direction of the printhead and has a width of only a single pixel. Then, when the nozzle that is responsible for printing this pixel line becomes defective, the whole line will disappear. If, in that instant, the printer is in the single-pass mode, there will be no efficient way to compensate for this defect.

This problem may be solved according to the present invention by configuring or programming the segmentation unit to search for critical (nozzle failure sensitive) image items such as thin horizontal lines, so that an appropriate failure compensation strategy may be applied proactively or precautionarily. Of course, the ultimate failure compensation strategy can only be determined when the exact location is known where the nozzle failure has occurred, and this information will be available only a certain time after the failure has been detected. However, it is possible and advisable to proactively adopt a multi-pass print mode for such critical segments, so that the powerful failure compensation strategies that require a multi-pass mode are readily available. Then, when a nozzle failure is detected in the first pass of a two-pass mode, the defect may be compensated in the second pass. If the failure is detected only in the second pass, at least every second pixel in the defective line will have been printed already in the first pass, so that the visible effect of the failure is at least mitigated and complete loss of information is avoided.

According to another optional feature of the present invention, at least two and preferably more than two different failure compensation strategies are implemented in the printer, e.g. by storing appropriate compensation programs in the memory of the failure compensation unit, and these compensation strategies are ordered in a sequence with increasing image quality and decreasing productivity. Then, the segmentation process comprises a step of specifying for each segment a minimum requirement for image quality, depending on the image information contained in the segment, and the controller selects the first compensation strategy in the sequence that fulfils this minimum requirement.

As has been mentioned already, the darkness or brightness of an image area is an important criterion for selecting the failure compensation strategy. In the segmentation process, this criterion may be quantified by measuring a primary image classifier which is a measure for the darkness or the brightness of the image area. In the case of a bi-level print process in which a single pixel can only be printed either in black or in white, a suitable primary image classifier may, for example, be the compensation strategies and, especially, a frequent switching between single-pass and multi-pass, may itself lead to a loss in productivity, it is preferable to apply a low-pass filter to the segments in order to reduce the number of switch operations.

The present invention is not only applicable to black and white printers but also to color printers. In a color printer, the hybrid failure compensation process described above may be applied individually to each color separation image, preferably with different segmentation criteria for the different colors, because, for example, a defect in a yellow color separation will be less visible than one in cyan. In case of a color printer, it is also possible to employ additional inter-color failure compensation strategies. For example, in four color printing with the basic colors yellow, cyan, magenta and black with subtractive color composition, a failure of a black nozzle may be compensated by superimposing yellow, magenta and cyan pixels. Consequently, a failure of a cyan nozzle, for example, may be compensated to some extent by inserting black pixels so as to reproduce at least the grey level of the surroundings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1:
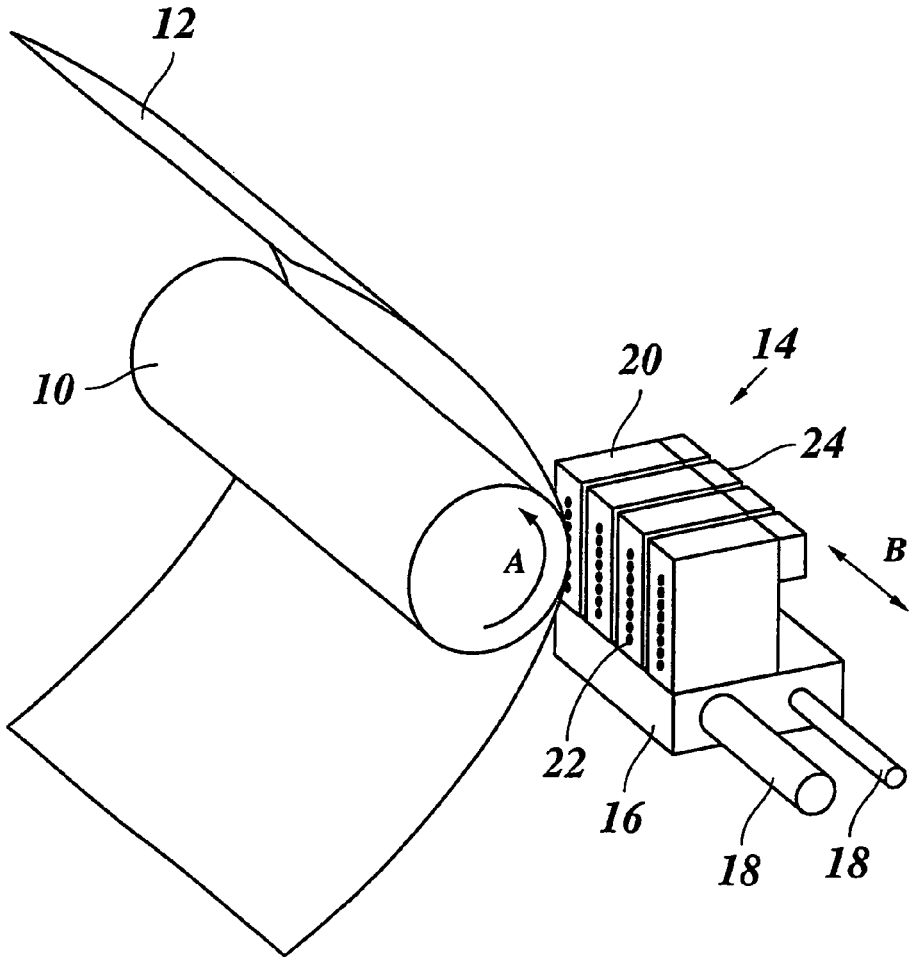
FIG. 1 is a diagram showing essential parts of an ink jet printer to which the present invention is applicable.

As is shown in FIG. 1, an ink jet printer comprises a platen 10 driven for rotation in the direction of an arrow A for transporting a paper sheet 12 which serves as an image recording medium. A printhead 14 is mounted on a carriage 16 which is guided on guide rails 18 and travels back and forth in the direction of an arrow B along the platen 10 so as to scan the paper sheet 12. The printhead 14 comprises four nozzle heads 20, one for each of the basic colors yellow, cyan, magenta and black. On the side facing the sheet 12, each nozzle head 20 has a linear array of nozzles 22. The nozzle heads 20 are energized in accordance with image information of an image to be printed on the sheet 12. Each nozzle 22 can be energized separately so as to eject an ink droplet which will form a dot at a corresponding pixel position on the sheet 12. Thus, when the printhead 14 performs a single stroke along the platen 10, each nozzle 22 can be energized to draw a single pixel line of the intended image. As a result, during each forward or backward stroke of the carriage 16, the printhead 14 will print a swath or band of the image, and the number of pixel lines of the swath will correspond to the number of nozzles 22 present in each nozzle array. Although only eight nozzles 22 have been shown per nozzle head 20 in FIG. 1, in practice, the number of nozzles will be considerably larger.

Each nozzle head 20 has an electronic failure detector 24 capable of detecting failure of a nozzle in the associated nozzle head. The failure detector will also indicate the location of the nozzle or nozzles that have become inoperative. As an alternative, a failure detector may be provided near one end of the platen 10 in a position outside of the area of the sheet 12, and when the carriage has reached the position of this detector at the end of a stroke, the detector will check whether ink droplets have actually been expelled from each of the nozzles 22.

When a failure of one or more of the nozzles 22 has been detected by the failure detectors 24, one of a plurality of failure compensation strategies will be called-up in order to compensate for the breakdown of the nozzle or nozzles, as will be explained in detail below.

Figure 2:
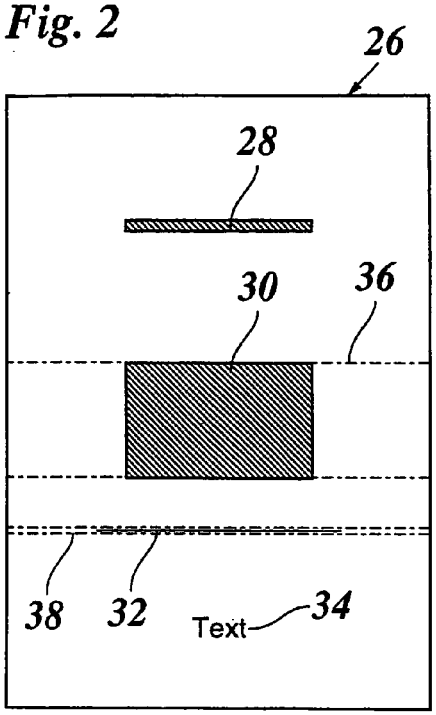
FIGS. 2 to 5 show images of a page to be printed, for illustrating the effect of a segmentation process.

FIG. 2 shows an example of an image of a page 26 to be printed. In this simplified example, the image comprises a number of image items 28, 30, 32 and 34 which include different types of image information. In the example shown, item 28 is a relatively dark narrow horizontal bar, item 30 is a photograph with comparatively large dimensions and a comparatively high average darkness, item 32 is a thin horizontal line which has only a width of a single pixel, and item 34 is a text item.

The photograph 30 is relatively sensitive to nozzle failure, because a missing pixel line would be clearly visible on the dark background. The thin horizontal line 32 is also very sensitive to nozzle failure, because a failure of the pertinent nozzle would lead to a complete loss of image information. In contrast, the items 28 and 34 are less sensitive to nozzle failure, because a missing pixel line would always be located in the vicinity of a borderline where there exists a sharp contrast between dark and bright which would somewhat shield the image defect so that the latter is less perceptible. Under these circumstances, items 30 and 32 would require a failure compensation strategy which results in a high image quality and avoids a complete loss of image information, respectively. Such compensation strategies will generally require a slower operation mode of the printhead, so that the time required for printing the page 26 would be increased. On the other hand, the items 28 and 34 would permit a failure compensation strategy which only mitigates the effect of the nozzle failure rather than completely compensating for the same, and such failure compensation strategies permit a higher printing speed.

In order to be able to adopt an optimal failure compensation strategy in terms of image quality and productivity for each of the items 28–34, a segmentation process is applied to the image in order to identify the different image items and to evaluate the type of image information contained therein. In FIG. 2, two preliminary segments 36 and 38 corresponding to the items 30 and 32 are indicated in dot-dashed lines. Since a failure compensation strategy will always apply to one or more complete strokes of the printhead 14, the segments 36 and 38 each extend over the whole width of the page 26. For simplicity, it is assumed here that the rest of the page 26, i.e. the areas outside of the segments 36 and 38 form segments that can be printed with a simple, relatively fast failure compensation strategy.

Figure 3:
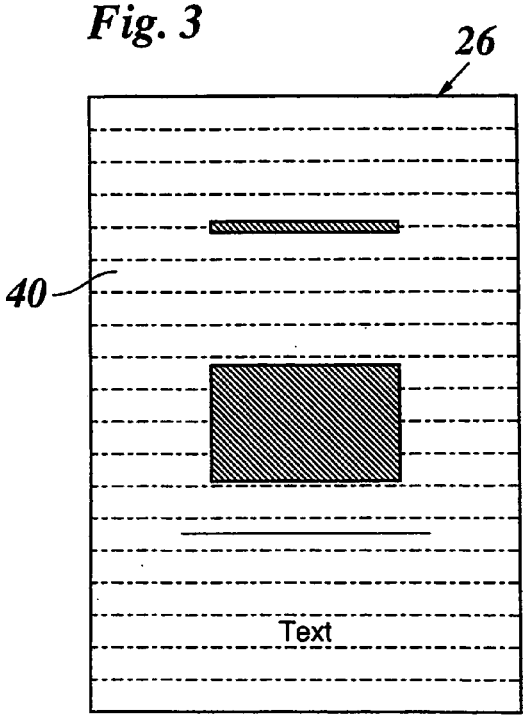

FIG. 3 shows the page 26 divided into a number of swaths 40 which are each printed in a single stroke of the printhead 14. It is assumed here that the printer operates in a single-pass mode, so that the swaths 40 do not or seldom overlap, and the sheet 12 will be transported by the width of a single swath after each stroke of the printhead.

Figure 4:
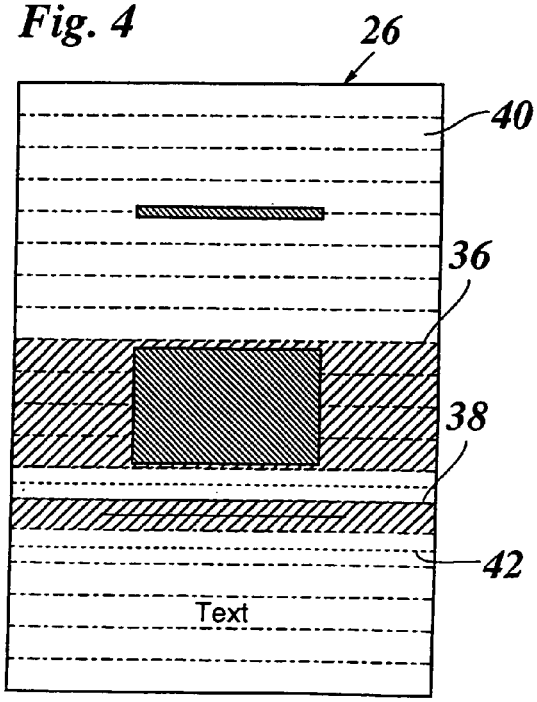
Figure 5:
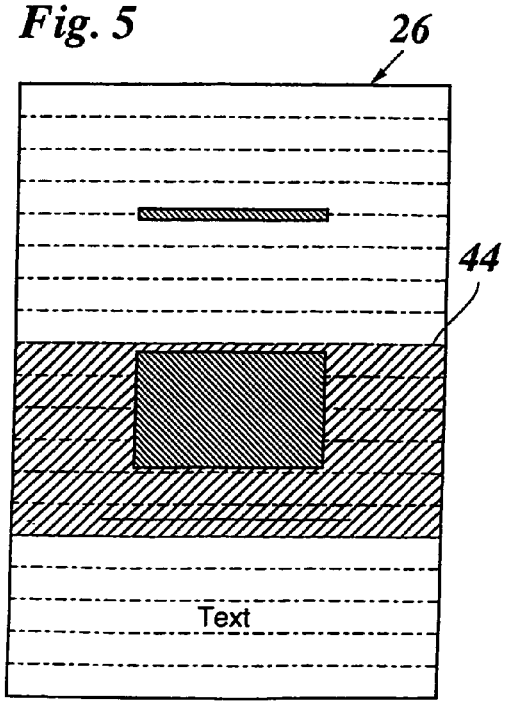

In FIG. 4, the size of the segments 36, 38 has been matched to the raster of swaths 40. It can be seen that the segments 36 and 38 are separated only by a single swath. As an example, it shall be assumed that the failure compensation strategy adopted for the segments 36 and 38 requires a two-pass mode, in which there is an overlap of 50% between the swaths covered by the printhead in the forward stroke and the rearward stroke. This has been symbolized by dot-lines 42 above and below the segment 38. When the print mode is switched from single-pass to two-pass or vice versa, one half of a swath must be wasted. It would therefore not be efficient to switch over to the single-pass mode for the one swath existing between the segments 38 and 36. For this reason, the pattern of segments is subjected to a low-pass filtering in order to avoid a too frequent and inefficient switching between the print modes. The result is shown in FIG. 5 where the segments 36 and 38 have been united to a single segment 44.

Figure 6:
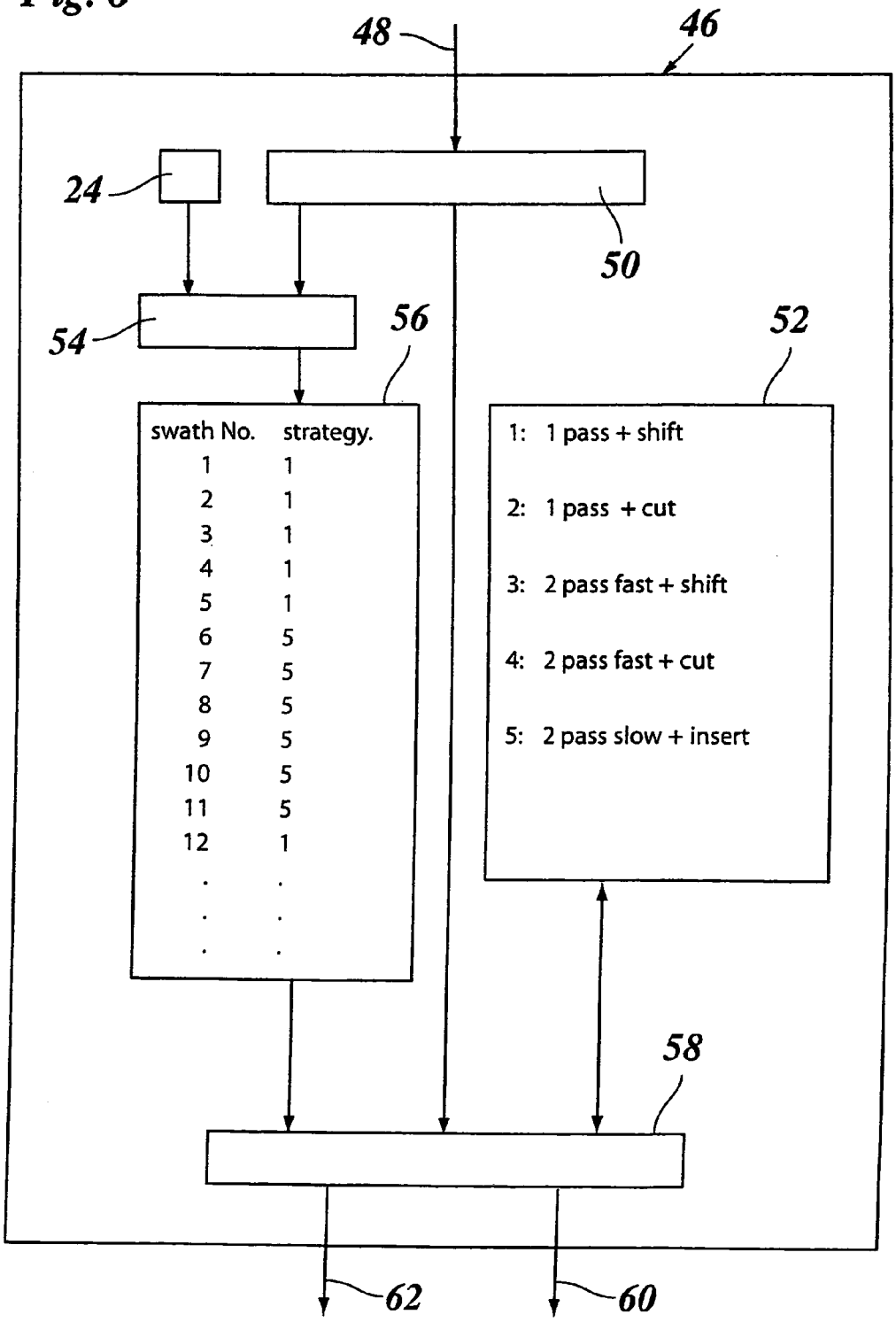
FIG. 6 is a block diagram of a failure compensation unit of the printer.

FIG. 6 is a block diagram of a failure compensation unit 46 for the printer. The failure compensation unit may be configured as a physical unit comprising one or more processors, memories and the like or may be implemented in the general control software of the printer. The image data to be printed are input as a pixel bit stream 48 and are buffered in a print data file 50. A memory 52 includes a number (5 in the given example) of failure compensation strategies, e.g. in the form of program code. The failure compensation strategies will be described below.

A segmentation unit 54 receives detection signals from the failure detectors 24 and has access to the data file 50 so as to perform the segmentation process described above with reference to FIGS. 2 to 5. The result is a strategy file 56 which assigns one of the failure compensation strategies stored in the memory 52 to each of the (single-pass) swaths 40. The swaths are counted from the bottom of the page 26 in FIG. 5. In the example shown, swaths No. 6 to 11 form the segment 44 for which the compensation strategy No. 5 is applied, whereas strategy No. 1 is applied to the rest of the page.

A controller 58 reads the strategy file 56 and calls-up the failure compensation strategies from the memory 52 as determined by the strategy file. The controller also reads the image data file 50, modifies the image data in accordance with the pertinent failure compensation strategy and outputs the modified image data 60 to the nozzle heads 20 and generates control data 62 to be output to other components of the printer such as carriage drive, paper transport and the like, so that the image will be printed in accordance with the failure compensation strategies as scheduled in the strategy file.

The various failure compensation strategies stored in the memory 52 will now be explained in conjunction with FIGS. 7 to 13.

Figure 7:
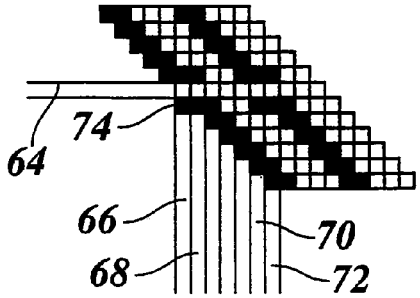
FIGS. 7–12 are diagrams for explaining different failure compensation strategies.

Strategy No. 1, which is called "single-pass and shift" is illustrated in FIG. 7. By way of example, it is assumed that the image of the pertinent segment consists of two slanting lines having each a width of two pixels and separated by a gap of three white pixels. The printer operates in the single-pass mode, so that all the information of a given pixel line has to be printed with only one nozzle of the nozzle head 20 for the respective color. It is assumed that a nozzle failure has occurred in pixel line 64. Consequently, the pixels in line 64 and columns 66, 68, 70 and 72 should but cannot be printed with the pertinent nozzle, and a defect in the form of a white pixel line occurs in the printed image. In order to mitigate the visual impression of this defect, the pixels in columns 66–72 are shifted either upwards into the line above line 64 or downward into the line below line 64. In column 66, the pixel cannot be shifted upwards because the pixel thereabove would be black anyway. This is why this pixel is shifted downward to the location 74. In contrast, the pixel in column 68 is shifted from line 64 into the line immediately thereabove. The same holds true for the pixels in columns 72 and 70, respectively. Thus, the average darkness of the image is conserved even in the vicinity of the line 64. Keeping in mind that the pixel size is largely exaggerated in FIG. 7 and will in practice be close to the limit of spatial resolution of the human eye, the resulting visual impression is fully acceptable. This failure compensation strategy also conserves the full productivity of the printer, because the operating speed of the printhead need not be reduced. However, this strategy would be less effective if the segment to be printed would consist of a solid black area.

Figure 8:
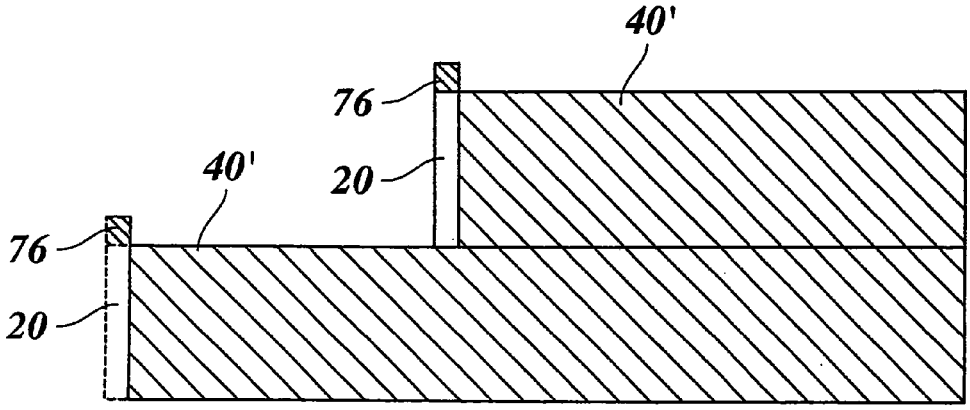

Failure compensation strategy No. 2 "single-pass and cut" is slightly less productive but permits a complete failure compensation. This strategy, which is illustrated in FIG. 8, is applicable when a nozzle failure occurs in a top or bottom end portion of the nozzle array of a nozzle head 20. In FIG. 8, the nozzle head 20 is symbolized by a rectangle, and an end portion 76 containing the inoperative nozzle has been hatched. The compensation strategy consists of cutting away, i.e. disabling the nozzles in the end portion 76, so that the swath 40' that is actually printed has a slightly reduced width. The paper transport distance at the end of a printhead stroke is reduced accordingly, so that the swaths 40 are seamlessly butted together, as can be seen in FIG. 8.

Figure 9:
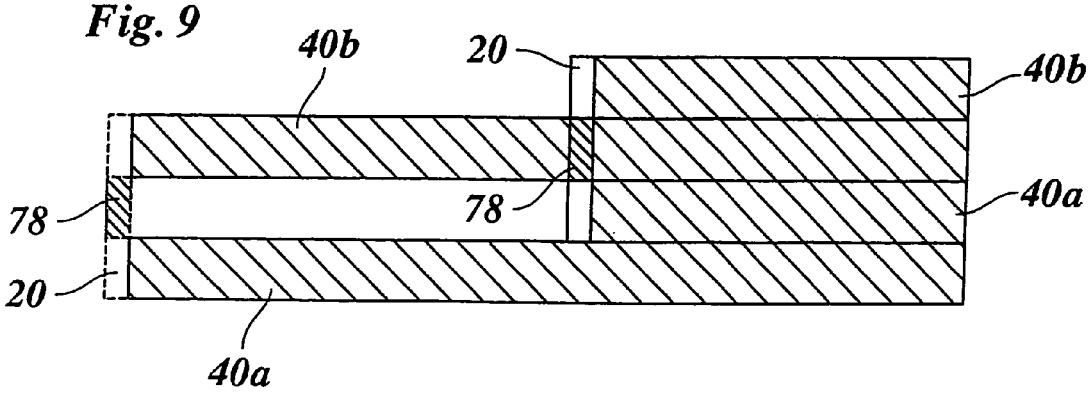

FIG. 9 illustrates a modification of this strategy, which is even less productive but permits compensation for a nozzle failure in a central portion 78 of the nozzle head 20. In this case, the central portion 78 having a length of one third of the complete nozzle array is disabled, so that the swath printed in a single stroke consists of two separate sub-swaths 40*a*, 40*b*. The gap between these swaths is inserted in the return stroke by the swath 40*a*, i.e. the swaths 40*a* and 40*b* are interleaved. In the example shown in FIG. 6, this strategy has not been implemented.

Figure 10:
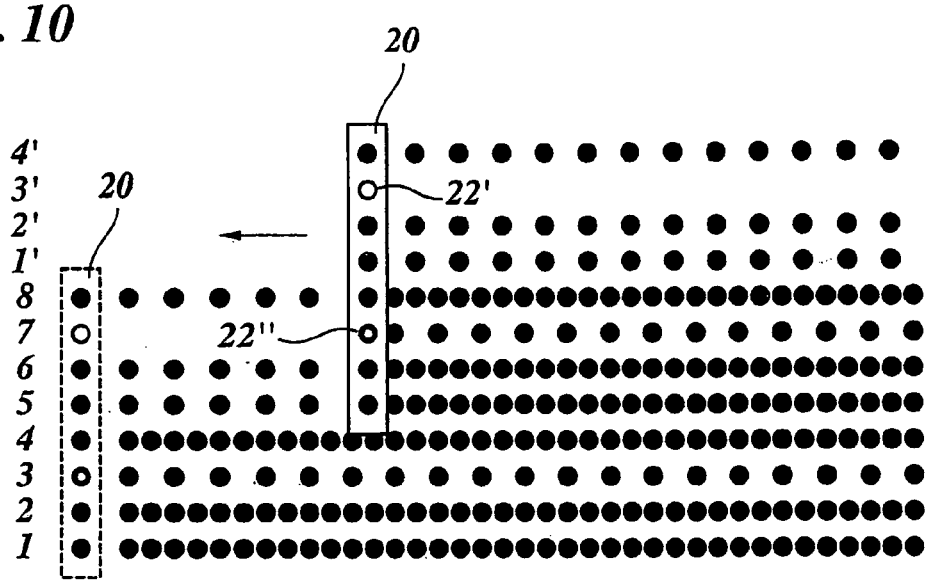

Failure compensation strategy No. 3 "two pass fast and shift" will now be explained in conjunction with FIGS. 10 and 11. This strategy employs the shift mechanism that has already been described in conjunction with FIG. 7, but now in a fast two-pass mode. A two-pass mode or, more generally, a multi-pass mode has the advantage that two or more nozzles are involved in printing a single pixel line, so that a nozzle failure will affect only some of the pixels in the line. This is illustrated in FIG. 10, where, in lines 1–8, all pixels having an odd column number have been printed in a forward pass n. In lines 1–4, even-numbered pixels had been already printed in a previous return pass n−1. Due to a breakdown of a nozzle 22', pixels are missing in lines 3, 7 and 3'. However, as can be seen in line 7, every second pixel can still be printed with an operative nozzle 22". The black pixels in line 3 have been printed in the same way. Thus, switching to a two-pass mode has the effect that, even in case of a nozzle failure, the corresponding pixel line will not be missing completely but is still printed with an optical density of 50%.

Figure 11:
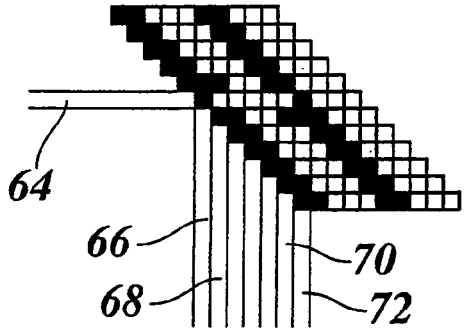

By adopting the shift mechanism discussed above, the result can be improved further, as has been shown in FIG. 11. This figure shows the same image as FIG. 7, but now only the pixels in columns 68 and 70 need to be shifted, and the optical impression is improved significantly.

In the fast two-pass mode, the carriage 16 travelling along the platen 10 is driven with twice the normal speed, while the dot generation frequency of the nozzles 22 is kept at the original value. Thus, although two passes are needed for printing a complete swath, the productivity is almost as high as in the single-pass mode. However, a certain loss in productivity is caused by the necessity to decelerate the carriage 16 and to reverse its direction of movement more frequently. This is why strategy No. 3 is less productive than strategy No. 1 and even less productive than strategy No. 2, if the cut-away portion 76 of the nozzle array is relatively short. On the other hand, a multipass mode leads to an improvement in the overall image quality because defects resulting from dot position errors, for example, can be made smooth.

The failure compensation strategy No. 4 shown in FIG. 6, "two-pass fast and cut" employs the fast two-pass mode in combination with the cut procedure illustrated in FIG. 8.

Figure 12:
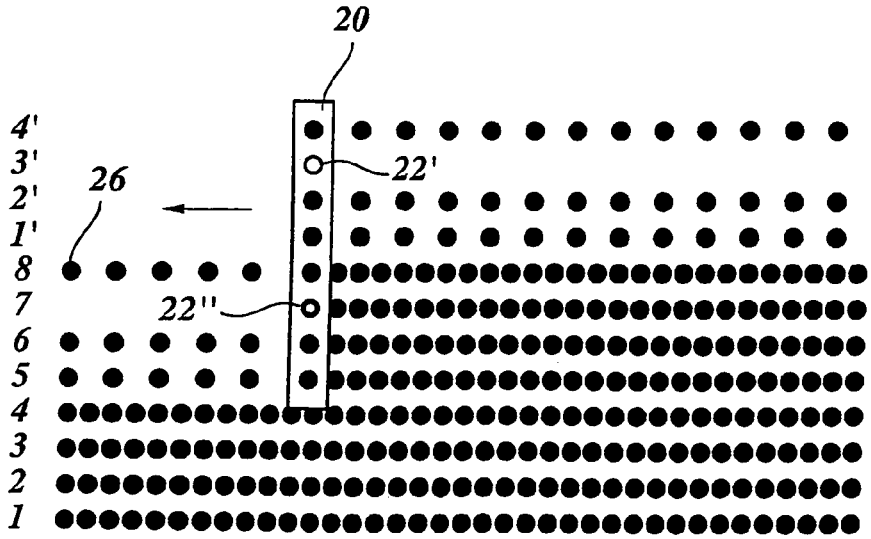

The failure compensation strategy No. 5 "single pass slow and insert" is illustrated in FIG. 12. Here, the two-pass mode is adopted, but the carriage is moved only with normal speed, and the dot generation frequency of most of the nozzles 22 is reduced to 50%. As a consequence, the productivity of the print process is also reduced to 50%. On the other hand, this strategy has the advantage that a complete failure compensation can be achieved even in cases where nozzle failure occurs in a central portion of the nozzle array, so that the cut strategy of FIG. 8 would not work, or in cases where nozzle failure occurs for two adjacent nozzles, so that the shift strategy would not work. To compensate for the failure of nozzle 22' in FIG. 12, the complementary nozzle 22" is operated with the normal drop generation frequency, i.e. twice the frequency of the other nozzles, so that all the pixels missing in line 7 can be filled-in with the nozzle 22".

In a modified embodiment, it is possible that the printer operates with a nominal dot generation frequency of 10 kHz, for example, but is also capable of operating with twice the nominal dot generation frequency, i.e. 20 kHz. The mode with nominal frequency will then be used, for example, in a quality mode in order to achieve an optimal image quality, whereas the mode with double frequency, in which the image quality may be slightly less, will be adopted in a draft mode, for example. Then, in the quality mode, the strategy shown in FIG. 12 may be applied with the nominal dot generation frequency and double carriage speed, and only the nozzle 22" will be operated with double frequency, so that a higher productivity can be achieved.

Of course, other failure compensation strategies that are known in the art may also be implemented, and the set of selectable compensation strategies may be varied depending upon the operating mode (draft, normal or quality) of the printer.

Figure 13:
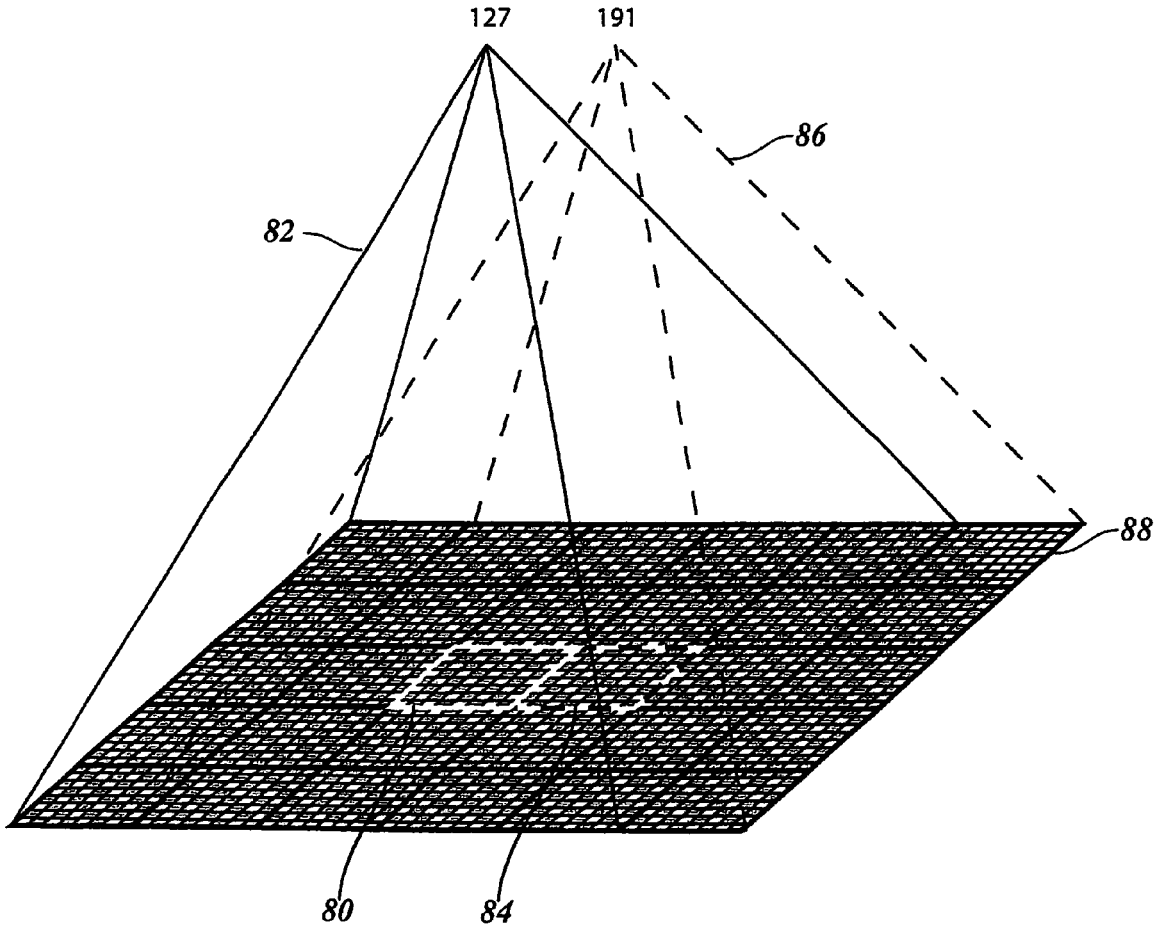
FIG. 13 is a diagram illustrating a step in the segmentation process.

Details of the segmentation process employed in the segmentation unit 54 will now be explained with reference to FIG. 13. This figure shows a pixel pattern of a portion of an image to be printed, as specified in the data file 50. In the example shown, most of the area has a grey level of 50%, i.e. one half of the pixels is black and the other half is white. The image area is divided into square basic areas of, preferably, 32×32 pixels, although only 8×8 pixels have been shown in the drawing. One basic area 80 has been highlighted in FIG. 13 by a white borderline.

A first step in the segmentation process consists of measuring the average brightness of each basic area by counting the number of white pixels. This average brightness will be taken as a primary image classifier for determining the failure compensation strategy to be applied. The value 0 is assigned to black pixels, and the value 255 is assigned to white pixels. Thus, the average image value of the basic area 80 will be 127. In general, a high value of the primary image classifier means that a rather productive failure compensation strategy, e.g. strategy No. 1, can be applied, whereas a low primary image classifier means that one of the high quality strategies, e.g. strategy No. 5, has to be applied.

In the next step, the primary image classifiers are subjected to context filtering in view of the fact that a defect caused by a nozzle failure will be less visible when it occurs near a border between the dark area and an adjacent bright area. To this end, a square window of 5×5 basic areas is shifted over the image, with the basic area 80 that is currently inspected being in the center of this window. In FIG. 13, the 5×5 window surrounding the basic area 80 is indicated as the base of a pyramid 82. The primary image classifiers measured for each of the 25 basic areas in the window 82 are subjected to maximum filtering. Since, in the example shown, all 25 basic areas have the primary image value of 127, the maximum is also 127, as is indicated on the top of the pyramid symbolizing the window 82. However, when the window is shifted by one basic area to the right, in order to inspect a basic area 84, the window, which is now symbolized by a pyramid 86 shown in dashed lines, includes also a brighter basic area 88 which has a basic image classifier of 191. Then, maximum filtering leads to a filtered image value of 191 for the basic area 84. In this way, by shifting the window over the whole page 26, a filtered primary classifier is obtained for each basic area.

In a simplified version of the segmentation process, the next step consists of comparing the filtered primary classifiers to appropriate threshold values. When the filtered primary classifiers of all basic areas in a row extending over the whole width of the page 26 exceed the highest threshold value, then this row of basic areas can be classified as part of a segment to which the failure compensation strategy No. 1 applies. On the other hand, if none of the filtered primary classifiers in this row exceeds the lowest threshold value, then this row will be classified as part of a segment to which failure compensation strategy No. 5 applies. In this way, the provisional segment 36 shown in FIG. 2 can be obtained, whereas the items 28, 32 and 34 have passed the context filtering procedure for strategy No. 1. The segment 38 corresponding to the single pixel line 32 is obtained by a different process, as will be explained below.

Figure 14:
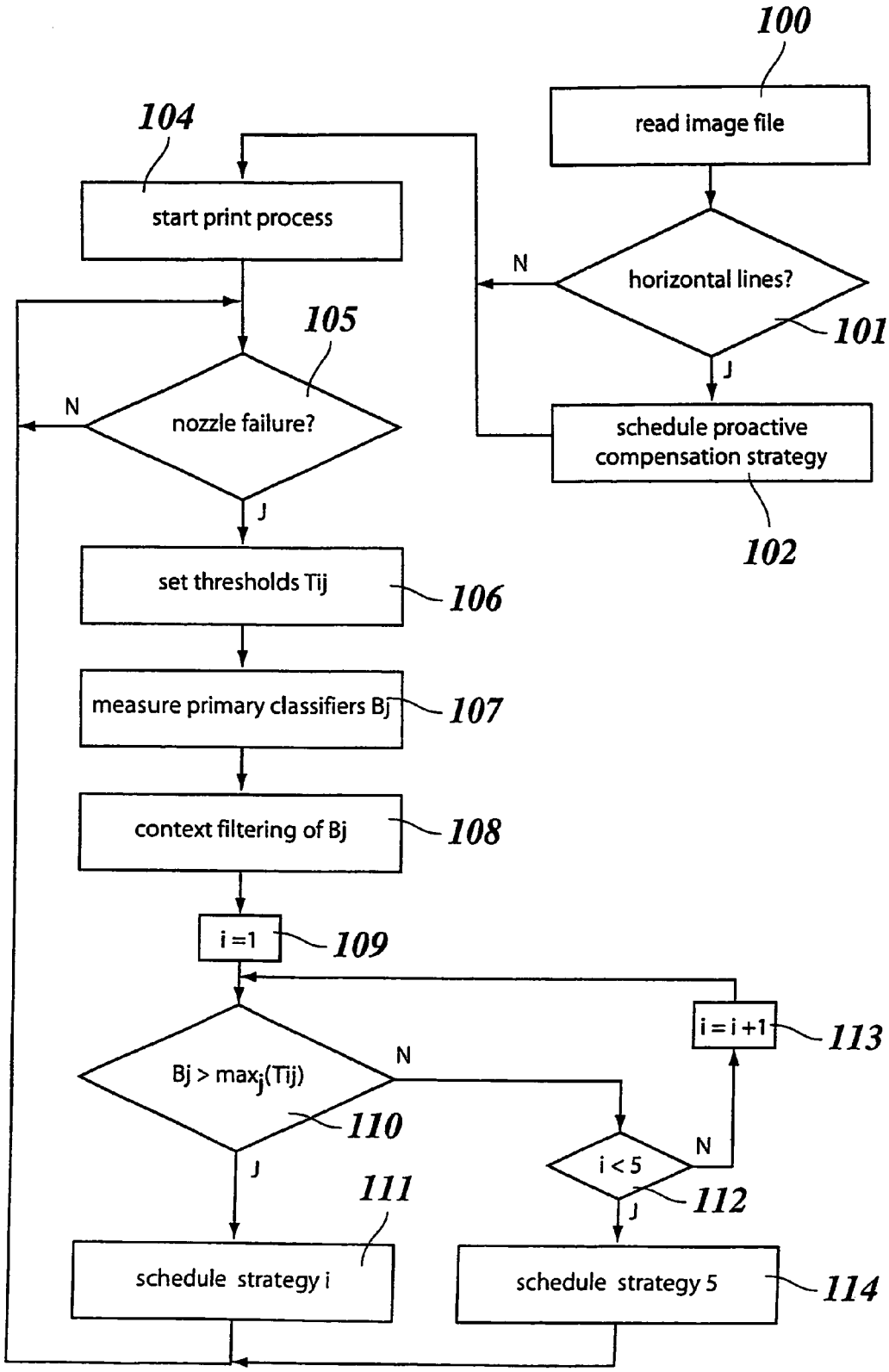
FIG. 14 is a flow chart of a process for selecting a failure compensation strategy in a print process.

FIG. 14 is a flow chart illustrating a more elaborated segmentation process.

In step 100, the data file 50 is read-in. In step 101, the whole image of the page 26 is checked for thin horizontal lines such as the line 32 in FIG. 2. This is achieved by conventional image processing techniques that are known in the art. If one or more of such horizontal lines are found, a proactive failure compensation strategy is scheduled in step 102. This step includes the identification of the segment 38, as in FIG. 2, and the matching of the segment to the swath width, as in FIG. 4. In the example shown, the steps 100–102 are performed before the operation of the printhead 14 starts. It is further specified in step 102 that the failure compensation strategy No. 5 shall be adopted for the segment 38, even though it is not known at that instant whether a nozzle failure will actually occur and which nozzle will be affected. In any case, a two-pass mode will be scheduled for this segment. This has the advantage that the failure compensation process can readily be activated if the demand occurs. Thus, a complete loss of information can reliably be avoided.

In a modified embodiment, it would also be possible to schedule the failure compensation process No. 3 for horizontal lines having a width of two pixels, for example.

It should further be observed here that it would also be possible to employ the failure compensation strategy No. 1 (shift) for single-pixel lines. Then, the line as a whole would be shifted by one pixel. However, in the case of high quality printing of CAD graphics, where positional accuracy is important, this strategy may not be acceptable.

Subsequent to step 102, the printhead 14 is started to operate in step 104. If no thin horizontal lines have been found in step 101, then the step 102 is skipped.

In step 105, it is checked by means of the failure detectors 24 whether or not a nozzle failure has occurred, and the location of the nozzle failure or failures is communicated to the segmentation unit 54. If no nozzle failure has been detected, the step 105 is repeated in a loop while the page is being printed.

As soon as a nozzle failure occurs, threshold values Tij for the segmentation process are set in step 106. The index i (i=1, . . . , 5) identifies the failure compensation strategy to which the threshold value applies. It will be noted that, as is shown in FIG. 6, the compensation strategies are ordered in a sequence with increasing image quality and decreasing productivity. Thus, i=1 means highest productivity and i=5 means highest quality.

In the segmentation process of this embodiment, primary image classifiers Bj are measured for basic areas (such as 80) with different sizes, e.g. with sizes of 8†×†8, 16×16, 32×32 pixels and so on (and possibly also for different window sizes such as 5×5 or 3×3 basic areas). The second index j of the classifiers Bj and of the threshold values Tij identifies the type or size of basic area to which the classifiers and threshold values apply.

In step 107, the primary classifiers Bj are measured for the various sizes of the basic areas, of course always for rows of basic areas extending over the whole width of the page 26.

In step 108, context filtering is applied individually to each set of primary classifiers Bj.

In step 109, the index i is set to 1. In step 110, it is checked whether all the filtered primary classifiers Bj for all sizes of the basic areas and for all basic areas in the row are larger than the maximum $\max_j(Tij)$ of the threshold values Tij. Since, in the present instant, i has been set to 1, the maximum is taken over the threshold values Tij. If the condition checked in step 110 is fulfilled, the failure compensation strategy i (1) is adopted in step 111. Since the values Bj have been compared to the maximum of the threshold values Tij in step 110, the failure compensation strategy No. 1 with the highest productivity will be applied only if the values Bj for all sizes of the basic areas have passed the test in step 110.

If the test in step 110 has failed, it is checked in step 111 whether the index i has reached the maximum value 5. If this is not the case, i is incremented in step 113, and the process loops back to step 110. Thus, the loop consisting of the steps 110, 111, 112 and 113 identifies the failure compensation strategy with the highest productivity which still provides a sufficient image quality for the segment that is being inspected. If none of the strategies No. 1–4 has passed the test in step 110, the loop is exited with step 114 where the strategy No. 5 for highest quality is scheduled.

Subsequent to step 111 or step 114, the process loops back to step 105, where it is checked whether a new nozzle failure has occurred while the print process proceeds. It will be understood that the steps 105 through 114 are repeated until the whole page 26 or at least a certain number of adjacent swaths 40 has been examined with basic areas of all sizes, thereby determining the dimensions of the segments 36, 38 as in FIG. 4. Finally, although this is not shown in FIG. 14, the segments are subjected to low-pass filtering in order to remove unreasonably small gaps between segments of the same type, as has been shown in FIG. 5.

The threshold values Tij determined in step 106 may of course depend upon the locations of the defective nozzles as detected in step 105. Thus, step 106 should be performed after step 105. However, the steps 107 and 108 may be performed prior to step 106 or to step 105 or even before the print process has started in step 104. This will reduce the processing time needed after a nozzle failure has been detected and will therefore permit a quicker reaction time when a nozzle failure occurs.

On the other hand, the nozzle failures detected in step 105 may be stored in a nonvolatile memory, so that they are readily available when the printer has been switched off and is switched on again at a later time.

Due to the powerful and yet productive failure compensation mechanism according to the present invention, it is possible to extend the cleaning or maintenance intervals for the printer and/or to reduce the number of instances where service personal has to be called for mending nozzle failures.

With increasing resolution of printers, and hence with increasing numbers of nozzles or other print units and decreasing dimensions of the print units, the likelihood of nozzle failures becomes larger, not only when the printer is in use but already in the production process of the printhead. The present invention may also tolerate a certain number of nozzle failures for a virgin printhead, thereby increasing the yield in the manufacturing process of the printhead.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing method using a printhead containing a plurality of print units, each being capable of printing a pixel line when the printhead is scanned over a recording medium, wherein the printing method is controlled to compensate for a failure of a print unit, which comprises storing a plurality of failure compensation strategies, dividing an image to be printed into segments containing different types of image information, and selecting different ones of the stored compensation strategies for printing different segments of the image.

2. The method according to claim 1, wherein the segments extend over the whole width of the image to be printed.

3. The method according to claim 2, wherein the dimension of the segments in a direction normal to the scanning direction (B) of the printhead is adapted to the length of an array of print units of the printhead.

4. The method according to claim 1 comprising the steps of sorting the stored compensation strategies in a sequence of increasing image quality and decreasing productivity, assigning to each segment a criterion (Tij) specifying a minimum requirement for image quality, and selecting, for a segment to be printed, the first strategy in the sequence that fulfills the criterion assigned to that segment.

5. The method according to claim 4 comprising a step of filtering the pattern of segments with a low-pass spatial frequency filter for reducing the number of switching operations from one compensation strategy to another.

6. The method according to claim 1 comprising a step of automatically detecting the failure of the print unit and automatically activating or adapting a failure compensation strategy in accordance with the detected failure.

7. The method according to claim 1 comprising the steps of searching the image to be printed for nozzle failure sensitive items, and proactively applying a compensation strategy in accordance with the search result.

8. The method according to claim 1, wherein the failure compensation strategies comprise at least one strategy that is applicable in a single-pass mode of the printhead and at least one strategy that is applicable in a multi-pass mode of the printhead.

9. The method according to claim 1, wherein the step of dividing the image into segments includes a step of extracting a primary image classifier (Bj) from each area of the image, said primary image classifier being a measure for the brightness of that area, and determining the segments on the basis of the values of the primary image classifiers (Bj) of the image areas contained therein.

10. The method according to claim 9, which comprises context filtering the primary classifiers (Bj) of the image areas and determining the segments on the basis of the filtered classifiers.

11. The method according to claim 10, wherein the image is divided into basic areas comprising a plurality of pixels, the primary classifier (Bj) is measured for each basic area, and context filtering is applied to blocks consisting of a plurality of basic areas.

12. The method according to claim 9, wherein at least one threshold value (Tij) is defined for each failure compensation strategy (i), and the failure compensation strategy for a segment is selected by comparing the smallest primary image classifier (Bj) that has been found for the segment, to said threshold values (Tij).

13. The method according to claim 11, wherein primary image classifiers (Bj) are measured for basic areas of different sizes, and the primary classifiers obtained for each basic area size are compared to respective threshold values (Tij).

14. A printer comprising a transport system for a recording medium, a printhead containing a plurality of print units each of which being capable of printing a pixel line when the printhead is scanned over the recording medium, and a failure compensation unit for controlling the print operation such that a failure of a print unit is compensated, wherein a segmentation unit is provided for dividing an image to be printed into segments containing different types of image information, and wherein the failure compensation unit comprises a memory for storing a plurality of compensation strategies and a controller for selecting one of said compensation strategies in accordance with the segment to be printed.

* * * * *